United States Patent [19]

Miyamoto et al.

[11] 4,007,310

[45] Feb. 8, 1977

[54] METHOD OF DESENSITIZATION USING DESENSITIZING COMPOSITION

[75] Inventors: Akio Miyamoto; Hiroharu Matsukawa, both of Fujimiya; Nobuo Yamamoto, Minami-ashigara, all of Japan

[73] Assignee: Fuji Photo Film Co., Ltd., Minami-ashigara, Japan

[22] Filed: Mar. 21, 1975

[21] Appl. No.: 560,680

[30] Foreign Application Priority Data

Mar. 22, 1974 Japan ..... 49-32337

[52] U.S. Cl. ..... 428/195; 282/27.5; 427/150; 427/151; 428/207; 428/446; 428/447; 428/913; 428/914

[51] Int. Cl.[2] ..... B41M 5/12

[58] Field of Search ..... 427/146, 150, 151, 369; 428/195, 199, 211, 446, 447, 452, 537, 913, 914; 282/27.5

[56] References Cited

UNITED STATES PATENTS 3,299,112 1/1967 Bailey ..... 260/448.2 E

*Primary Examiner*—Thomas J. Herbert, Jr.
*Assistant Examiner*—Bruce H. Hess
*Attorney, Agent, or Firm*—Sughrue, Rothwell, Mion, Zinc & Macpeak

[57] ABSTRACT

A method of desensitizing comprising contacting a color developer capable of forming a color upon contact with a color former with a desensitizing composition comprising the reaction product of (a) an alkylsiloxane, an alkylsilmethylene or an alkylsilane, and (b) an alkylene oxide or an alkylene imine (wherein the alkylene imine may be a tertiary amine).

9 Claims, No Drawings

METHOD OF DESENSITIZATION USING DESENSITIZING COMPOSITION

BACKGROUND OF THE INVENTION

1. Field of the Invention

This invention relates to a method for desensitization using a desensitizing composition and, more specifically, to a method using a desensitizing composition which reduces or eliminates the effect of a developer (an electron accepting compound, e.g., a solid acid) capable of coloring a color former (a substantially colorless, electron donating organic compound).

2. Description of the Prior Art

It has long been known to form a color image through the reaction of a color former and a color developer. The principle is practically utilized in pressure sensitive copying sheets (as disclosed, for example, in U.S. Pat. Nos. 2,505,470, 2,505,489, 2,550,471, 2,548,366, 2,712,507, 2,730,456, 2,730,457 and 3,418,250) and heat sensitive recording sheets (as disclosed, for example, in Japanese Patent Publication No. 4160/68 and U.S. Pat. No. 2,939,009). Furthermore, a printing method has also been known in which a color image is formed by supplying an ink containing a color former through a medium such as a stencil to a sheet coated with a color developer (as disclosed in German Pat. No. 1,939,962).

Pressure copying sheets can be prepared by dissolving a color former in a solvent such as a chlorinated paraffin, an alkylnaphthalene, an alkylated diphenylethane or an alkylated diphenylmethane, dispersing the color former solution in a binder or microencapsulating the color former solution, and then coating the composition on a support such as a paper or a synthetic resin film, on the one hand, and coating, as a color developer, an acid clay, a phenol-formaldehyde resin, a metal salt of an aromatic carboxylic acid or the like, on the other hand.

Heat sensitive recording sheets can be prepared by coating, on a support, a color former and a color developer together with a heat-fusible substance such as acetanilide. Heat-fusible substances are those substances which melt by heating and dissolve the color former.

In general, a color former and a color developer are coated respectively over the entire surface of a support. Therefore, it is necessary to prevent a color reaction in some way in the portions in which the formation of a color image is not required or permitted. For this purpose, a desensitizing agent is usually coated by printing on certain portions of a color developer coated layer to prevent the color reaction. Known desensitizing agents, for example, include long chain primary alkylamines such as dodecylamine and quaternary ammonium salts such as dodecyltrimethyl-ammonium chloride as described in U.S. Pat. No. 2,777,780; monoalkylamines, alkylamines or tertiary amines comprising ethanolamine adducts with ethylene oxide as described in Japanese Patent Publication No. 29546/71; secondary alkylamines such as didodecylamine, tertiary alkylamines such as triethylamine, primary arylamines such as aniline or aralkylamines such as benzylamine.

However, conventional desensitizing agents have disadvantages and it is, therefore, desired to develop superior desensitizing agents.

Disadvantages of the conventional desensitizing agents are set forth below.

1. Insufficient desensitizing effects are exhibited by conventional desensitizing agents and, in particular, no effects are exhibited for xanthene color formers such as 7-diethylamino-3-dibenzylaminofluoran.

2. Conventional desensitizing agents have an unpleasant amine odor and the surface on which they are coated is colored.

3. The images formed, due to the color reaction, on the surface on which conventional desensitizing agent are coated undergo a marked discoloration and fading.

4. When conventional desensitizing agents are left together with microcapsules, swelling of the membranes of the microcapsules results, and as the case may be, the membranes can even be destroyed.

SUMMARY OF THE INVENTION

An object of this invention is to provide a method using a desensitizing agent which exhibits extremely high desensitizing effects on all color formers.

Another object of this invention is to provide a method using a desensitizing agent which neither has an unpleasant odor nor colors the surface on which the desensitizing agent is coated.

A further object of this invention is to provide a method using a desensitizing agent which does not cause any swelling or destruction of microcapsules.

Still a further object of this invention is to provide a method using a desensitizing agent which does not cause any discoloration or fading in the image formed by the color reaction.

After a great amount of research, it has been found that the above objects are completely accomplished with a desensitizing agent comprising the reaction product of (a) an alkylsiloxane, an alkylsilmethylene or an alkylsilane and (b) an alkylene oxide or an alkylene imine (wherein the alkylene imine may be a tertiary amine), by contacting the desensitizing agent or a desensitizing composition containing the desensitizing agent with a color developer.

DETAILED DESCRIPTION OF THE INVENTION

The above organic silicone reaction products used in this invention (hereinafter compounds of the invention) are known as nonionic surface active agents containing silicon and are those compounds having a Si—O—Si bond, a Si—C—Si bond or a Si—Si bond in the molecule and containing an alkyleneoxy group or alkyleneimino group. These compounds can be synthesized, for example, by the methods as described in U.S. Pat. Nos. 3,057,901 and 3,299,112, *Bulletin of the Chemical Society of Japan*, 40, 2675 (1967) and *Journal of Industrial Chemistry*, 71, 1675–1682 (1968).

The reaction products of the alkylsiloxane, the alkylsilmethylene or the alkylsilane and alkylene oxide used in this invention include, preferably, the compounds represented by the following general formula:

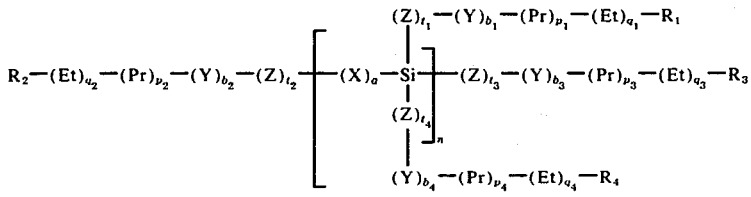

wherein

Y represents

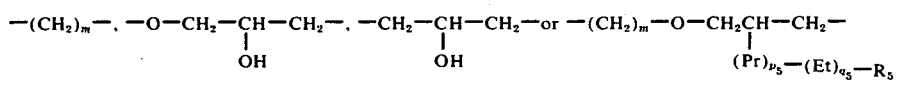

Z represents

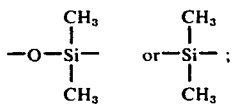

Et represents $-O-CH_2CH_2-$;

Pr represents

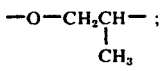

$R_1$, $R_2$, $R_3$, $R_4$ and $R_5$ each represents a hydrogen atom, a hydroxyl group, an alkoxy group (e.g., having 1 to 20 carbon atoms), an alkyl group (e.g., having 1 to 20 carbon atoms)

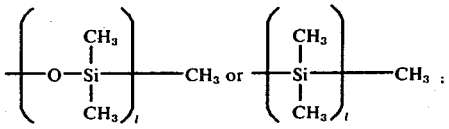

X represents —O— or $-CH_2-$; $l$ is an integer of 1 to 50;

$m$ is an integer of 1 to 6;

$n$ is an integer of 1 to 50;

$a$ is 0 or 1;

$b_1$ through $b_4$ each represents 0 or 1;

$p_1$ through $p_5$ each represents 0 or an integer of 1 to 15;

$q_1$ through $q_5$ each represents 0 or an integer of 1 to 50;

and $t_1$ through $t_4$ each represents 0 or an integer of 1 to 5.

The positions for (P$r$) and (E$t$) in the above general formula are interchangeable.

Typical examples of the compounds used in this invention are shown in the following:

(1)

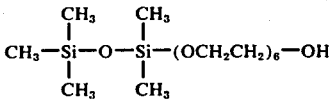

(2)

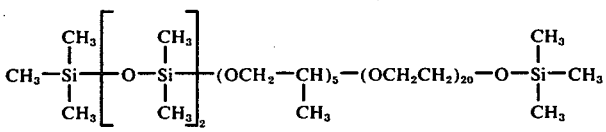

(3)

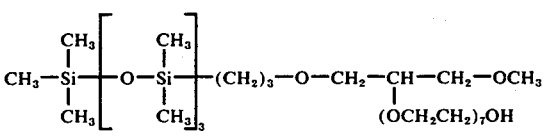

(4)

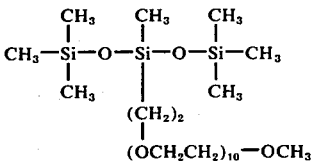

(5)

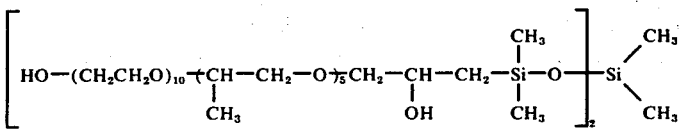

-continued
(6)
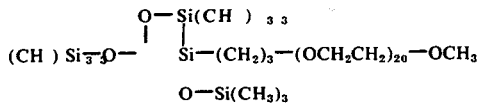
(7)
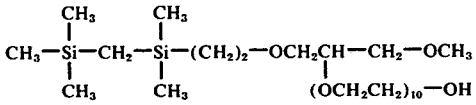
(8)
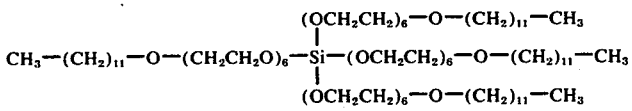
(9)
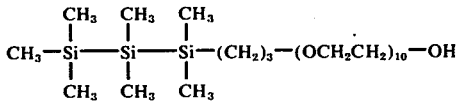
(10)
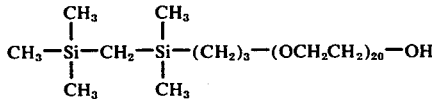
(11)
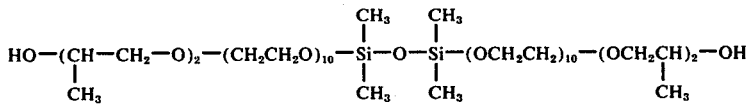
(12)
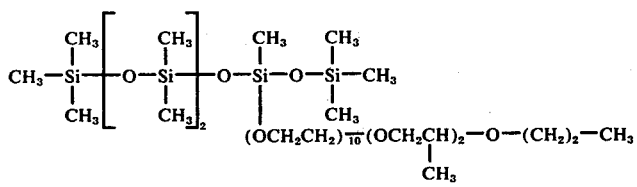
(13)
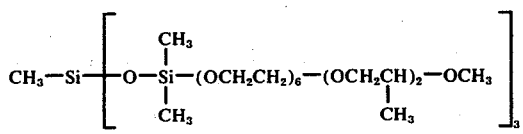
(14)
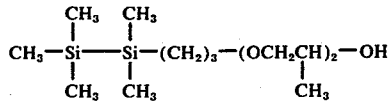
(15)
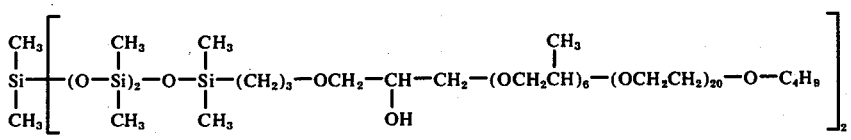
(16)
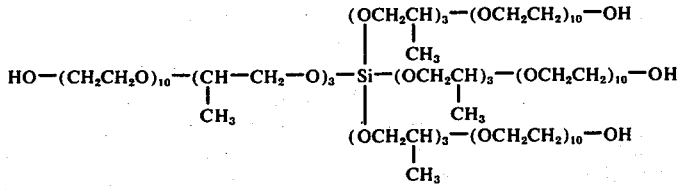
(17)
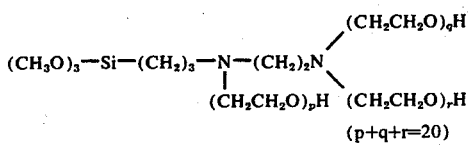
(p+q+r=20)

-continued (18)

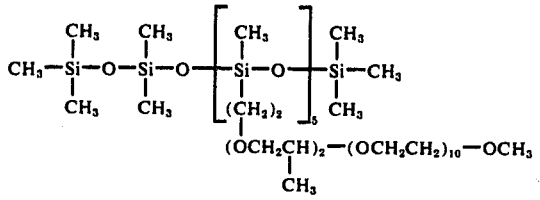

(19)

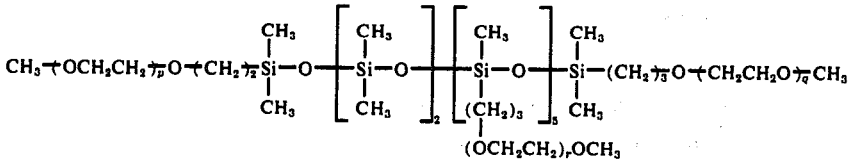

(p+q+r=10)

(20)

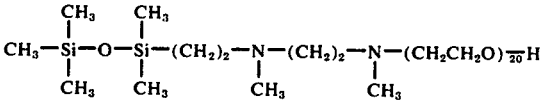

(21)

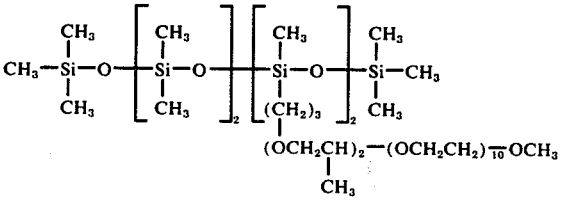

(22)

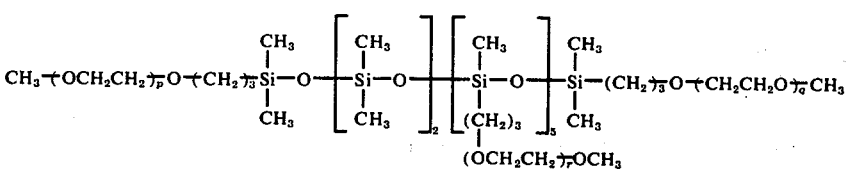

(p+q+r=20)

The desensitizing composition used in this invention contains the above compound as a desensitizing component and, if desired, various additives.

The compound used in this invention can be present in the desensitizing composition in an amount which can vary over a wide range, but it is desired that about 1 to 60 wt%, particularly 15 to 55 wt%, of the compound of this invention be present in the desensitizing composition.

The other components which can be employed in the desensitizing composition of this invention include, for example, materials generally employed in printing inks as described in detail in E. A. Apps, *Printing Ink Technology, Leonard Hill, Chapters* 2 to 9, London, (1961), and examples of these material are natural or synthetic high molecular weight compounds (in most cases not necessarily, used as a binder) in an amount of about 5 to 30% be weight such as ketone resins, polyamide resins, maleic acid resins, phenol resins, epoxy resins, alkyd resins, melamine resins, urea resins, nitrocellulose, ethylcellulose, butyral resins, polyvinyl alcohol, gelatin or shellac; inorganic and organic materials in an amount of about 5 to 50% by weight such as titanium oxide, zinc oxide, barium sulfate, calcium carbonate, talc, daolin, clay, bentonite or organic bentonite; vegetable oils in an amount of about 5 to 40% by weight such as linseed oil, tung oil, soybean oil or cotton seed oil; organic solvents in an amount of about 5 to 40% by weight such as methanol, ethanol, ethyl acetate, toluene, xylene or hexane, waxes such as paraffin, Japanese wax or microcrystalline wax; anti-offset agents in an amount of about 0.5 to 5% by weight such as starch or dextrin; and other conventional desensitizing agents, e.g., as a replacement for some of the desensitizing agent of this invention.

A mixture of the compound used in this invention and a polyoxyethylenealkylamine is particularly advantageous because of the high desensitizing effects obtained. A preferred polyoxyethylene alkylamine includes an adduct of an alkylamine having 12 to 20 carbon atoms and 5 to 20 moles of ethylene oxide. A suitable amount of the polyoxyethylene alkylamine ranges from about 0 to 500%, preferably 50 to 200%, by weight of the polyoxyethylenealkylamine to the desensitizing agent used in this invention.

It should be noted that the effect of the desensitizing composition as described above is not influenced by the types and the amounts of other components incorporated in the composition, or the form of these other components employed. The desensitizing composition can, thus, be easily prepared and is applied to a color developer layer using methods, for example, printing such as relief printing, flexographic printing or photogravure, spraying using a spray or manually with the composition in a crayon-or eraser-like form. The amount of the desensitizing composition of this invention coated is about 0.8 to 8.0 g/m$^2$, preferably 1.5 to 5.0 g/m$^2$, as the desensitizing agent.

The color developers to which the desensitizing composition used in this invention is applicable are electron-accepting substances. They are well known in the art and include, for example, clay minerals such as acid clay, activated clay or attapulgite; organic acids such as tannic acid, gallic acid or propyl gallate; acid polymers such as phenol-formaldehyde resins or phenolacetylene resins (as described in Japanese Patent Publication No. 20144/67 and Japanese Patent Application (OPI) Nos. 9812/73 and 14409/73); metal salts of aromatic carboxylic acids such as zinc salicylate, tin salicylate, zinc 2-hydroxynaphthoate or zinc 3,5-di-tert-butylsalicylate (as described in Japanese Patent Publication Nos. 32011/73 and 33923/73); and mixtures thereof. The color developer is coated together with a binder such as a styrene-butadiene latex on a support such as paper, a synthetic resin film-laminated paper or other supports, e.g., in an amount of about 0.5 to 8 g (as color developer)/m$^2$.

Color formers which react with the color developer to form a color are electron donating and substantially colorless organic compounds and include triarylmethane compounds, diphenylmethane compounds, xanthene compounds, thiazine compounds, spiropyran compounds and the like. Examples of triarylmethane compounds are 3,3-bis(p-dimethylaminophenyl)-6-dimethylaminophthalide, i.e., crystal violet lactone, 3,3-bis)p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide and 3-p-dimethylaminophenyl-3-(1-methylpyrrol-2-yl)-6-dimethylaminophthalide. Examples of diphenylmethane compounds are 4,4'-bis-dimethylaminobenzhydrin benzyl ether, N-halophenyl-leucoauramine and N-2,4,5-trichloro-phenyl-leucoauramine. Examples of xanthene compounds are rhodamine B-anilinolactam, rhodamine(p-nitroanilino)lactam, rhodamine B-(p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)fluoran, 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran and 7-diethylamino-3-(diethylamino)-fluoran. Examples of thiazine compounds are benzoyl-leucomethylene blue and p-nitrobenzyl-leucomethylene blue. Examples of spiro compounds are 3-methyl-spiro-dinaphthopyran, 3-ethyl-spiro-dinaphthopyran, 3,3'-dichloro-spiro-dinaphthopyran, 3-benzylspiro-dinaphthopyran, 3-methyl-naphtho-(3-methoxy-benzo)-spiropyran and 3-propyl-spiro-dibenzopyran.

The color former is dissolved in a synthetic or natural oil such as an alkylated diphenylmethane, an alkylated diphenylethane, an alkylated diphenyl, an alkylated terphenyl, a chlorinated paraffin, a chlorinated naphthalene, an alkylated naphthalene, kerosine, paraffin oil or naphthene oil, and then coated together with a binder on a support, e.g., in an amount of about 0.02 to 2.5 g (as color former)/m$^2$. Alternatively, the color former can be encapsulated using the method as described in, for example, U.S. Pat. No. 2,800,457, and then coated on a support, if desired, together with additives, e.g., an anti-smudge agent such as starch particles. In addition, the solution of the color former can be coated only on predetermined portions of a support.

The color former and the color developer can be used in a form suitable for pressure sensitive recording sheets or heat sensitive copying sheets as described above or for any other purposes.

This invention will be explained in greater detail by way of the following examples, by which the excellent effects of this invention can be seen.

The color developer sheets, color former sheets and desensitizing compositions, which were used in the examples to demonstrate the effects of the use of desensitizing agents, in the present invention, were prepared in the following manner. Unless otherwise indicated, all parts, percents, ratios and the like are by weight.

Preparation of Color Developer Sheet A

100 Parts of acid clay which had been treated with sulfuric acid was dispersed in 280 parts of water containing 10 parts of a 20% sodium hydroxide aqueous solution using a homogenizer, and to this, 10 parts of a 10% aqueous solution of the sodium salt of a methyl vinyl ether-maleic anhydride copolymer and 37 parts of a styrene-butadiene latex were added. The coating composition was coated on a support paper of 50 g/m$^2$ using air knife coating so as to provide a solid content of 10 g/m$^2$ and then dried, thus preparing an Color Developer Sheet A.

Preparation of Color Developer Sheet B

170 Parts of p-phenylphenol, 70 parts of a 37% aqueous solution of formaldehyde and 50 parts of water were heated at 160° C in the presence of conc. hydrochloric acid (as a catalyst) to condence the p-phenylphenol and formaldehyde, and then cooled to produce powdered phenol resin.

50 Parts of the phenol resin, 10 parts of polyvinyl alcohol and 500 parts of water were blended in a ball mill for 10 hours to produce coating composition (Coating Composition B).

Coating Composition B was coated on a support paper of 50 g/m$^2$ so as to provide a solid content of 2 g/m$^2$ and then dried, thus preparing Color Developer Sheet B.

Preparation of Color Developer Sheet C

4 Parts of sodium hydroxide was dissolved in 200 parts of water, and then 25 parts of 3,5-di-tert-butylsalicylic acid was dissolved therein while stirring.

Moreover, a solution of 7 parts of zinc chloride dissolved in 100 parts of water was slowly added to the above solution while stirring. Then, 50 parts of a 10% aqueous solution of polyvinyl alcohol was added, and blending was effected in a ball mill for 10 hours to produce Coating Composition C.

Coating Composition C was coated on a support paper of 50 g/m$^2$ so as to provide a solid content of 2 g/m$^2$ and then dried, thus preparing Color Developer Sheet C.

Preparation of Color Developer Sheet D

A coating composition obtained by blending 35 parts of Coating Composition B, 50 parts of Coating Composition C and 15 parts of pyrophyllite clay in a ball mill for 10 hours, Coating Composition D, was coated on a support paper of 50 g/m² so as to provide a solid content of 2 g/m² and then dried to produce Color Developer Sheet D.

Preparation of Color Former Sheet A 10 parts of acid-treated gelatin having an isoelectric point of 8.0 and 10 parts of gum arabic were dissolved in 60 parts of water at 40° C, and 0.2 parts of a sodium alkylbenzenesulfonate was added as an emulsifier thereto. Then, 50 parts of a color former containing oil was emulsified therein.

The above color former containing oil was prepared by dissolving 2.5% by weight of crystal violet lactone and 2.0% by weight of benzoyl-leucomethylene blue in an oil comprising 4 parts of diisopropylbiphenyl and 1 part of kerosene.

When the size of the emulsion droplets reached 8 $\mu$ on the average, 100 parts of water at 40° C was added to inhibit further emulsification.

While stirring, 210 parts of water at 30° C was added, and then a 20% hydrochloric acid aqueous solution was added to adjust the pH of the system to 4.4. The system was cooled to 8° C with further stirring, and then 1.5 parts of a 20% glutaraldehyde aqueous solution was added.

Subsequently, 30 parts of a 10% carboxymethylstarch aqueous solution was poured therein, a 25% sodium hydroxide aqueous solution was added dropwise to adjust the pH to 8.5, and then the temperature of the system was increased to 30° C to form microcapsules having hardened capsule walls.

10 Parts of cellulose flock was dispersed in the composition thus obtained, and then the composition was coated on a paper of 40 g/m² so as to provide a solid content of 6 g/m², thus preparing Color Former Sheet A.

Preparation of Color Former Sheet B

A color former-containing oil was prepared by dissolving 1% by weight of crystal violet lactone, 4% by weight of 7-diethylamino-3-dibenzylaminofluoran, 4% by weight of 3-diethylamino-7-phenylaminofluoran, 3% by weight of 3-diethylamino-7,8-benzofluoran, 0.5% by weight of 3,6-bis-methoxyfluoran and 2% by weight of benzoyl-leucomethylene blue in a mixture of 1 part of diisopropylnaphthalene, 1 part of diisopropylbiphenyl and 2 parts of 1-(dimethylphenyl)-1-phenylethane. Color Former Sheet B was prepared using 50 parts of the color former-containing oil in the same manner as in the preparation of Color Former Sheet A.

Preparation of Desensitizing Composition

25 Parts of an alkyd resin which had been modified with linseed oil and 75 parts of titanium oxide were uniformly blended on a three-roller mill to prepare a base composition. 4 parts of the base composition and 1 part of a desensitizing agent as shown in the following table were uniformly blended on a three-roller mill to prepare a desensitizing composition.

Method of Evaluation

A. Each desensitizing composition was coated by printing on Color Developer Sheets A to D so as to provide 5.0 g/m² of the composition. The desensitized areas on the resulting samples and the color former sheets were stacked facing to each other, and a load of 600 kg/m³ was applied to cause color formation. After irradiation of the sheets with ultraviolet light for 20 minutes by means of a Fade-o-meter, the sheets were left in the dark for 24 hours. The density was determined using a densitometer, and the desenstization was evaluated from the obtained relection visual density (Vis. D).

B. A paper coated with 5.0 g/m² of each desensitizing composition (a sheet obtained in the same manner as in (A)) was tested by writing manually with red, blue and black ball-pens and a fountain pen, and the discoloration and fading of the colored images were observed after the sheet was left for 1 week.

| Example and Reference No. | Desensitizing Agent | Densitization (Vis. D) Color Former Sheet A: Color Developer Sheet A | Color Developer Sheet B | Color Developer Sheet C | Color Developer Sheet D | Color Former Sheet B: Color Developer Sheet A | Discoloration and Fading of Image* |
|---|---|---|---|---|---|---|---|
| Example 1 | Compound 22 | 0.05 | 0.05 | 0.05 | 0.05 | 0.07 | 0 |
| Example 2 | Compound 18 | 0.05 | 0.05 | 0.06 | 0.06 | 0.08 | 0 |
| Example 3 | Compound 1 | 0.05 | 0.05 | 0.05 | 0.05 | 0.08 | 0 |
| Example 4 | Compound 2 | 0.05 | 0.05 | 0.05 | 0.06 | 0.07 | 0 |
| Example 5 | Compound 3 | 0.05 | 0.05 | 0.05 | 0.06 | 0.08 | 0 |
| Example 6 | Compound 5 | 0.05 | 0.05 | 0.05 | 0.05 | 0.08 | 0 |
| Example 7 | Compound 6 | 0.05 | 0.05 | 0.05 | 0.06 | 0.08 | 0 |
| Example 8 | Compound 7 | 0.05 | 0.06 | 0.06 | 0.06 | 0.08 | 0 |
| Example 9 | Compound 9 | 0.05 | 0.05 | 0.05 | 0.05 | 0.08 | 0 |
| Example 10 | Compound 17 | 0.05 | 0.05 | 0.06 | 0.06 | 0.08 | 0 |
| Example 11 | Mixture of Compound 21 and Compound A (2:1 by weight mixture) | 0.05 | 0.05 | 0.05 | 0.05 | 0.07 | 0 |
| Reference Example 1 | Compound B | 0.09 | 0.10 | 0.10 | 0.10 | 0.17 | X |
| Reference Example 2 | Compound C | 0.05 | 0.07 | 0.06 | 0.06 | 0.10 | X |
| Reference Example 3 | Compound D | 0.05 | 0.06 | 0.06 | 0.06 | 0.09 | X |
| Reference Example 4 | No desensitiz- | 1.08 | 1.05 | 0.94 | 1.04 | 1.10 | — |

-continued

| Example and Reference No. | Desensitizing Agent | Densitization (Vis. D) Color Former Sheet A: Color Developer Sheet A | Color Developer Sheet B | Color Developer Sheet C | Color Developer Sheet D | Color Former Sheet B: Color Developer Sheet A | Discoloration and Fading of Image* |
|---|---|---|---|---|---|---|---|
| | ing treatment | | | | | | |

Compound A

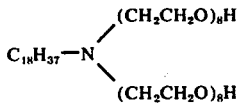

Compound B

Dodecyltrimethylammonium Chloride

Compound C

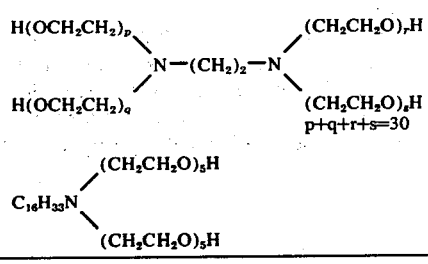

Compound D

*O: No discoloration and fading
X: Marked discoloration and fading

The same test as described above in Example 11 was carried out using a mixture comprising Compund 17 and a compound of the formula

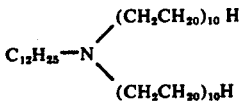

(1:1 by weight).

The results obtained were the same as obtained in Example 11.

The result above clearly demonstrate the utility of the compounds used in this invention. That is, the smaller the value of the desensitizing effect (Vis. D), the higher the effect, and a value less than 0.08 denotes a complete desensitizing effect. Therefore, it can be seen that the compounds used in this invention provide complete desensitizing effects on any of the color developers such as acid clay, a phenol-formaldehyde resin and a metal salt of an aromatic carboxylic acid. Moreover, as can be seen from the results above, the compounds used in this invention provide complete desensitizing effects as to a color former sheet containing 7-diethyl-3-dibenzylfluoran as a color former.

Conventional desensitizing agents cause a marked discoloration and fading of the images formed, while the compounds used in this invention scarcely cause a discoloration and fading of the images formed.

In addition, the compounds used in this invention are colorless and odorless and are considered not toxic in practice. Also, the compounds used in this invention do not cause the walls or microcapsules to swell, and thus the effects of this invention are obviously excellent.

While the invention has been described in detail and with reference to specific embodiments thereof, it will be apparent to one skilled in the art that various changes and modifications can be made therein without departing from the spirit and scope thereof.

What is claimed is:

1. A method for desensitizing a color developer capable of forming a color upon contact with a color former comprising contacting the color developer with a desensitizing composition which includes as a desensitizing agent the reaction product of (a) an alkylsiloxane, an alkylsilmethylene or an alkylsilane, and (b) an alkylene oxide or an alkylene imine, wherein the alkylene imine may be tertiary amine, said desensitizing agent having a Si—O—Si bond, a Si—C—Si bond or a Si—Si bond in the molecule and containing an alkyleneoxy group or an alkylemeimino group in the molecule, and wherein said desensitizing agent is employed in amounts of about 1 to 60% by weight of said desensitizing composition.

2. The method of claim 1, wherein said reaction product is a reaction product of an alkylsiloxane or an alkylsilmethylene and an alkylene oxide.

3. The method of claim 2, wherein said reaction product has the general formula

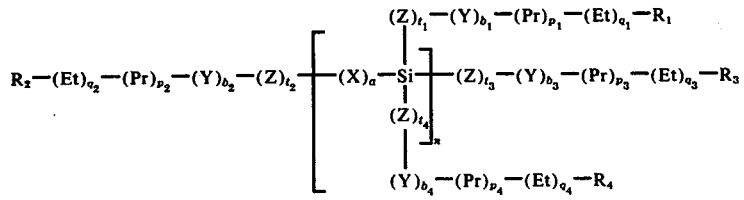

wherein

Y represents

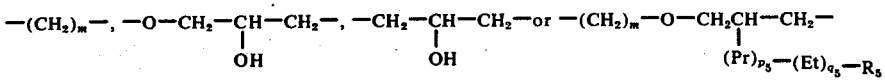

;

Z represents

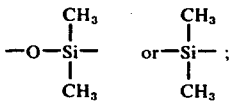

Et represents $-O-CH_2CH_2-$;
Pr represents

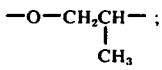

$R_1$, $R_2$, $R_3$, $R_4$ and $R_5$ each represents a hydrogen atom, a hydroxyl group, an alkoxy group, an alkyl group,

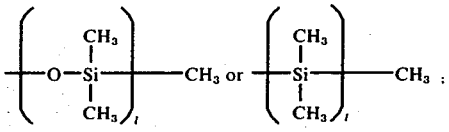

X represents —O— or $-CH_2-$;
$l$ is an integer of 1 to 50;
$m$ is an integer of 1 to 6;
$n$ is an integer of 1 to 50;
$a$ is 0 or 1;
$b_1$ through $b_4$ each represents 0 or 1;
$P_1$ through $P_5$ each represents 0 or an integer of 1 to 15;
$q_1$ through $q_5$ each represents 0 or an integer of 1 to 50; and
$t_1$ through $t_4$ each represents 0 or an integer of 1 to 5 and the positions for (P*r*) and (E*t*) in the above general formula are interchangeable.

4. The method of claim 3, wherein said reaction product is selected from the group consisting of

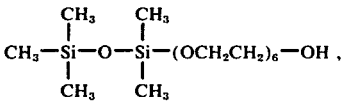

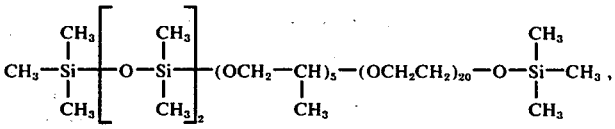

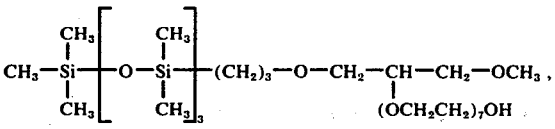

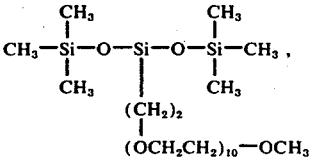

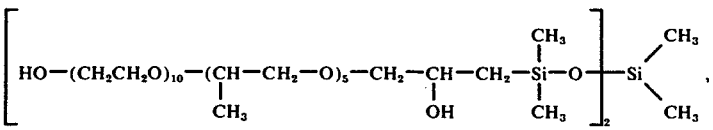

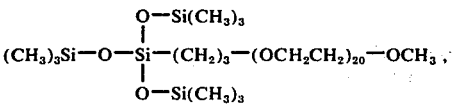

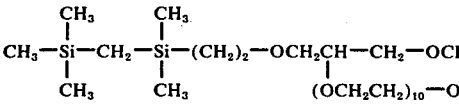

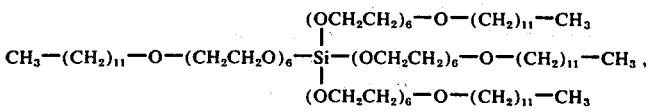

-continued
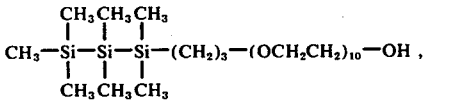
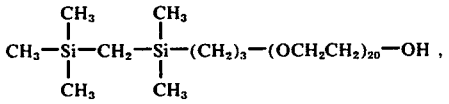
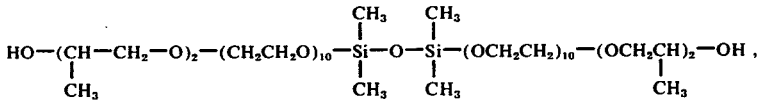
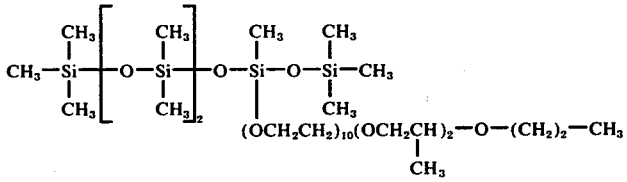
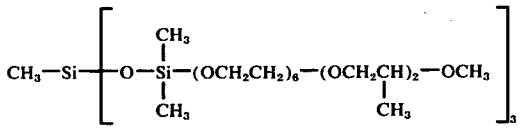
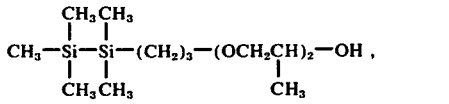
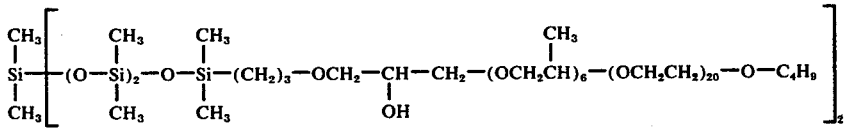
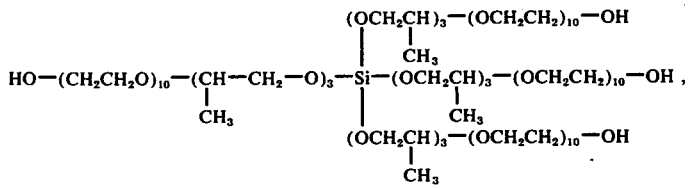
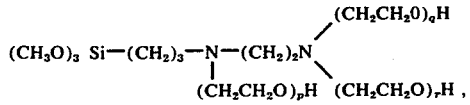
(p+q+r=20)
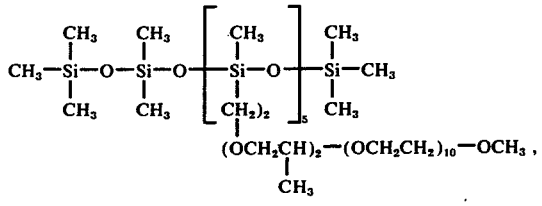
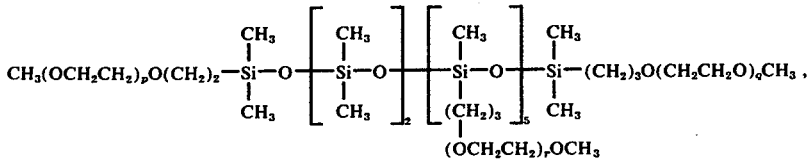
(p+q+r=10)

-continued

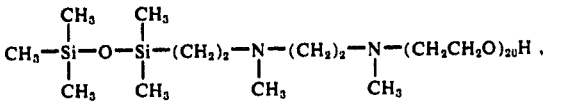

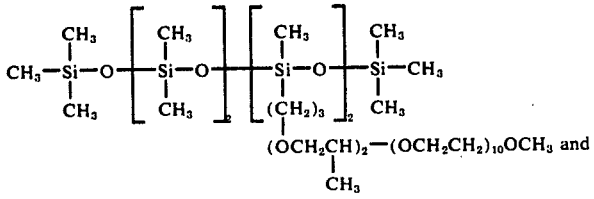

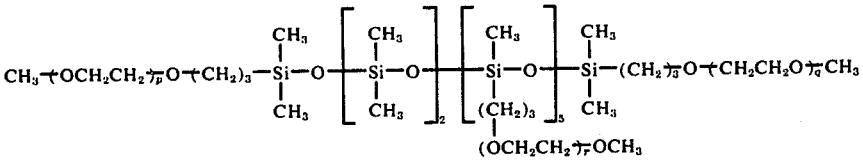

(p+q+r=20)

5. The method of claim 1, wherein said desensitizing composition further includes a natural or synthetic high molecular weight compound, an inorganic material, a vegetable oil, an organic solvent, a wax, an anti-off set agent or a desensitizing agent other than said reaction product.

6. A method for desensitizing a color developer layer coated on a support for use in color formation on contact with a color former comprising applying to said color developer layer a desensitizing composition which includes as a desensitizing agent the reaction product of (a) an alkylsiloxane, an alkylsilmethylene or an alkylsilane, and (b) an alkylene oxide or an alkylene imine, wherein the alkylene imine may be tertiary amine, said desensitizing agent having a Si—O—Si bond, a Si—C—Si bond or a Si—Si bond in the molecule and containing an alkylenoxy group or an alkyleneimino group in the molecule, and said desensitizing agent being employed in amounts of about 1 to 60% by weight of said desensitizing composition.

7. The method of claim 1, wherein said desensitizing composition is employed in desensitizing amounts.

8. The method of claim 1, wherein said desensitizing composition is employed in amounts of about 0.8 to 8.0 g/m² based on the desensitizing agent.

9. The method of claim 6, wherein said desensitizing composition is employed in desensitizing amounts.

* * * * *